United States Patent [19]

Weinerman

[11] Patent Number: 4,457,146

[45] Date of Patent: Jul. 3, 1984

[54] SLIDING DOOR LOCK

[75] Inventor: Lee S. Weinerman, Medina, Ohio

[73] Assignee: The Eastern Company, Strongsville, Ohio

[21] Appl. No.: 389,045

[22] Filed: Jun. 16, 1982

[51] Int. Cl.[3] ..... E05B 15/02; E05B 65/08; E05C 3/16

[52] U.S. Cl. ..... 70/100; 292/99; 292/216; 292/340; 292/DIG. 26; 292/25; 292/45

[58] Field of Search ..... 70/95, 99, 100; 292/25, 292/45, 99, 117, 216, 340, 341.11, 341.12, 341.18, DIG. 26

[56] References Cited

U.S. PATENT DOCUMENTS

| | | | |
|---|---|---|---|
| 1,497,947 | 6/1924 | Schwab | 292/341.18 |
| 2,530,330 | 11/1950 | Groeger . | |
| 2,540,686 | 1/1951 | Milburn . | |
| 3,190,682 | 6/1965 | Fox | 292/216 |
| 3,198,564 | 8/1965 | Welsh | 292/117 |
| 4,126,340 | 11/1978 | Pelcin . | |

FOREIGN PATENT DOCUMENTS

| | | | |
|---|---|---|---|
| 1129398 | 9/1959 | Fed. Rep. of Germany | 292/340 |

OTHER PUBLICATIONS

Eberhard Manufacturing Company Drawings and Brochures Relating to 5653, 5682, 5688, 5690, 5969, and 8804 Series Locks.

Kason Brochure Relating to 4000, 4005 and 4006 Series Locks.

Polar Drawings and Brochure Relating to No. 144 Lock.

*Primary Examiner*—Robert L. Wolfe

*Attorney, Agent, or Firm*—David A. Burge

[57] ABSTRACT

A door lock for sliding doors of trucks, vans and the like includes an exterior handle assembly and an interior handle assembly for actuating components carried in an interior housing assembly. The components include a pair of rotary latch bolts projecting through openings formed in opposite sides of the housing assembly. A pair of strikes are carried on spaced portions of a vehicle wall at locations on opposite sides of a vehicle access opening which is controlled by the door. The door is movable between a latched-closed position wherein one of the latch bolts latchingly engages one of the strikes to hold the door closed, and a latched-open position wherein the other of the latch bolts latchingly engages the other of the strikes to hold the door open. A thumb-operated lock control slide is carried by the housing assembly and provides one means for locking and unlocking the lock from inside the vehicle. A key cylinder provides a means for moving the control slide between locked and unlocked positions from outside the vehicle. The exterior handle assembly can be operated to unlatch the lock only when the control slide is in its unlocked position. The interior handle assembly can be operated regardless of the position of the control slide to release latching engagement between either of the latch bolts and its associated strike. A "slam override" feature permits the lock bolts to be moved into latching engagement with the strikes regardless of the position of the lock control slide, and prevents the driver from accidentally locking himself out of his vehicle by assuring that, when either of the latch bolts engages its associated strike, the thumb-operated slide is maintained in or moved to its unlocked position.

55 Claims, 14 Drawing Figures

SLIDING DOOR LOCK

BACKGROUND OF THE INVENTION

1. Field of the Invention

The present invention relates generally to a door lock for sliding doors on vehicles such as trucks, vans and the like and, more particularly, to a door lock for securely retaining a sliding door in either open or closed positions.

2. Prior Art

Previously proposed locks for sliding doors of trucks, vans and the like have characteristically suffered from a number of drawbacks. Many of these proposals have utilized handles that are subject to breakage during extensive use. Many have required the use of exteriorly exposed fasteners which are subject to corrosion as well as tampering, whereby the life of the lock and the security it provides are diminished. Many have required that unduly complex procedures be followed during installation, and have provided components which do not necessarily self-align, whereby installation can be improperly effected. Many provide no means of assuring that the operator of a vehicle will not accidentally lock himself out of the vehicle.

Most previously proposed locks fail to provide a "slam override" feature which permits a latch bolt to latchingly engage a strike and unlock the lock in a situation where the lock control has been locked before the latch bolt has had an opportunity to latchingly engage the strike. Most prior proposals also fail to provide constructions which are sufficiently sturdy and secure to assure that latching engagement will be maintained during the application of substantial lateral and/or transverse loadings.

SUMMARY OF THE INVENTION

The present invention addresses and overcomes the foregoing and other drawbacks of prior proposals by providing a novel and improved, durable and secure lock which is easily installed on sliding doors of trucks, vans and the like.

In accordance with the preferred practice of the present invention, a door lock for sliding doors or trucks, vans and the like includes an exterior handle assembly and an interior handle assembly for actuating operating components carried in an interior housing assembly. The operating components include a pair of rotary latch bolts projecting through openings formed in opposite sides of the housing assembly. A pair of strikes are carried on spaced portions of a vehicle wall at locations on opposite sides of a vehicle access opening which is controlled by the door. The door is movable between a latched-closed position wherein one of the latch bolts latchingly engages one of the strikes to hold the door closed, and a latched-open position wherein the other of the latch bolts latchingly engages the other of the strikes to hold the door open. A thumb-operated lock control slide is carried by the housing assembly and provides one means for locking and unlocking the lock from inside the vehicle. A key cylinder provides a means for moving the control slide to unlock the lock from outside the vehicle. The exterior handle assembly can be operated to unlatch the lock only when the control slide is in its unlocked position. The interior handle assembly can be operated regardless of the position of the control slide to move the control slide to release latching engagement between either of the latch bolts and its associated strike. If the control slide is in its locked position when the inside handle assembly is operated, it will be moved to its unlocked position as the inside handle assembly is operated. A "slam override" feature permits the bolts to be moved into latching engagement with the strikes regardless of the position of the lock control slide, and prevents the driver from accidentally locking himself out of his vehicle by assuring that, when either of the latch bolts engages its associated strike, the control slide is maintained in or moved to its unlocked position.

A feature of the invention lies in the strong, rigid type of connection which is provided as the lock latchingly engages one of the strikes. The housing and the strikes are configured such that a close-fitting, nesting type of engagement is established as portions of the lock housing are received within a strike cavity, whereby the lock can withstand significant lateral and transverse loadings while remaining securely latched.

A further feature of the invention lies in the security provided by the nesting type of engagement which is occurs between the interior housing and either of the strikes when either of the latch bolts is latchingly engaged with its associated strike. The strikes cooperate with the housing assembly to protectively enclose the regions wherein the rotary latch bolts latchingly engage striker pins carried by the strikes to prevent intrustion.

Another feature lies in the design of such operating components as are carried by the interior housing assembly. A minimal number of multi-functional parts are provided, each of which can be fabricated relatively inexpensively to provide a sturdy lock having highly reliable operating mechanism.

A further feature lies in its provision of exterior and interior components which are installed with ease on a sliding door, which self-align to assure proper installation, and which utilize no exteriorly-exposed fasteners.

Still another feature resides in the design of the strikes, each being formed from a minimal number of identical parts which can be assembled in alternate arrangements to provide left and right strikes that are mirror images of each other.

BRIEF DESCRIPTION OF THE DRAWINGS

The foregoing and other features of the present invention will be better understood by referring to the description of the preferred embodiment and claims which follow, taken together with the accompanying drawings, wherein:

DESCRIPTION OF THE PREFERRED EMBODIMENT

Figure 1:
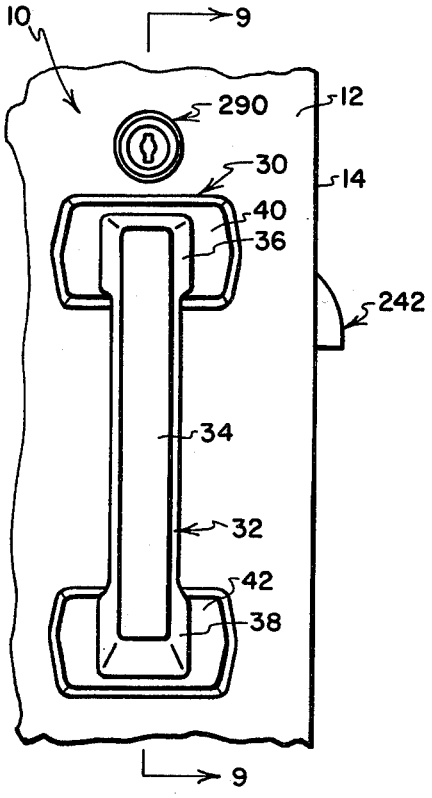
FIG. 1 is an exterior side elevational view of a portion of a sliding door of a vehicle with a lock embodying the preferred practice of the present invention mounted thereon.
Figure 2:
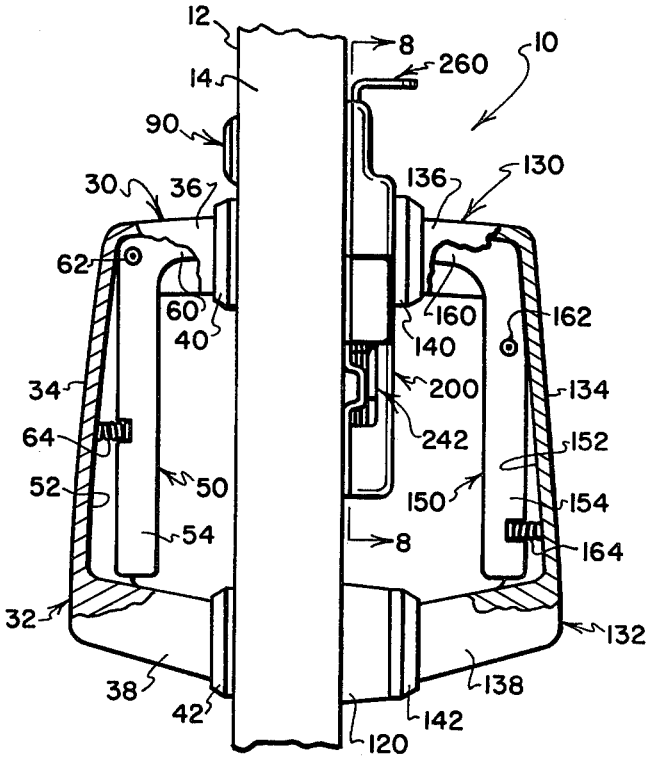
FIG. 2 is an end elevational view thereof with portions of interior and exterior handle assemblies broken away.
Figure 3:
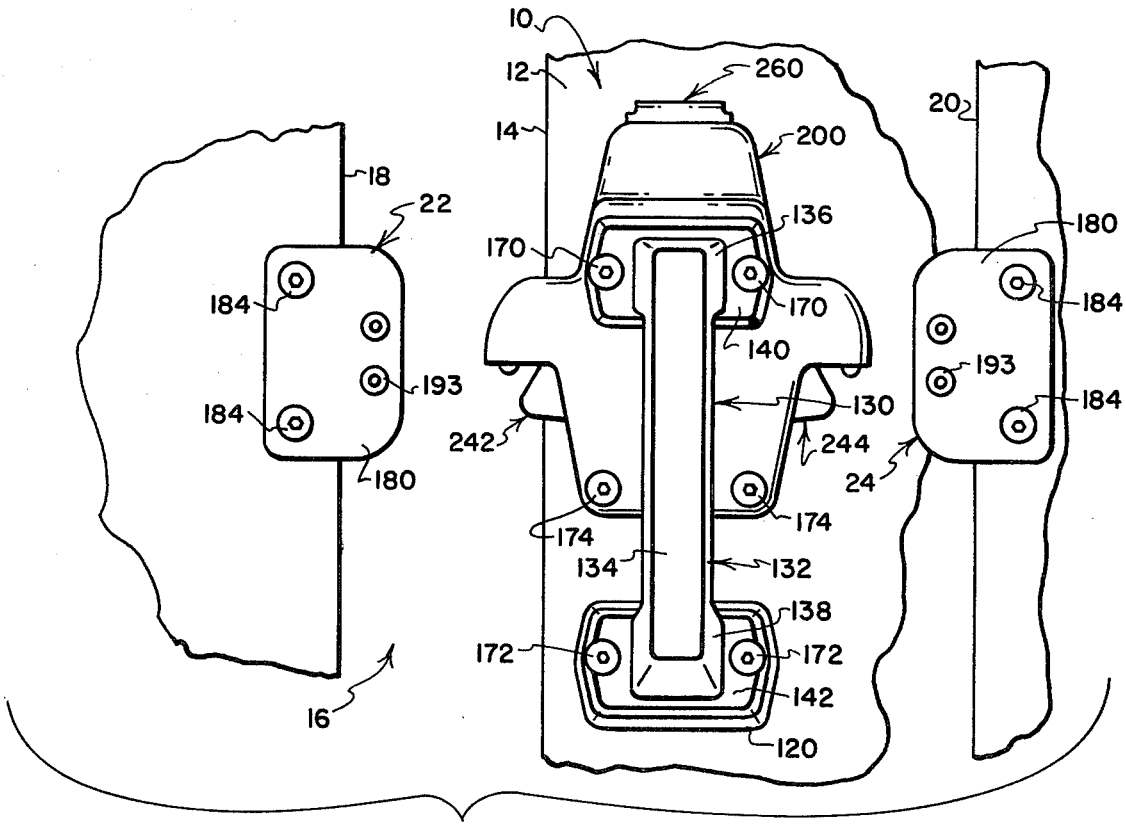
FIG. 3 is an interior side elevational view of portions of a vehicle door and side wall, with the lock shown in a position of disengagement with each of two spaced strikes.

Referring to FIGS. 1–3, a lock embodying the preferred practice of the present invention is indicated generally by the numeral 10. The lock 10 is shown mounted on a door 12 at a location near a vertical edge 14 of the door 12. The door 12 is a vehicle access door which is movable along a substantially horizontal path of travel between a latched-closed position wherein the door 12 closes a vehicle access opening 16, and a latched-open position wherein the door 12 provides access through the opening 16.

Referring to FIG. 3, portions of a vehicle wall located on opposite sides of the access opening 16 are indicated by the numerals 18, 20. A pair of strikes 22, 24 are mounted on the wall portions 18, 20. When the lock 10 is in latching engagement with the strike 22, the door 12 is in its latched-closed position. When the lock 10 is in latching engagement with the strike 24, the door 12 is in its latched-open position.

Before turning to a detailed description of the components of the lock 10, a brief overview of its principal components and a brief description of their function will be provided. Referring to FIGS. 1 and 2, such portions of the lock 10 as may be viewed from the exterior side of the door 12 include an exterior handle assembly 30 and a key-operated lock cylinder 290. Referring to FIGS. 2 and 3, such portions of the lock 10 as may be viewed from the interior side of the door 12 include an interior handle assembly 130 and an interior housing assembly 200.

The housing assembly 200 carries a pair of rotary latch bolts 242, 244. When the door 12 is in its latched-closed position , the latch bolt 242 is in latching engagement with the strike 22 and serves to hold the door 12 closed. When the door 12 is in its latched-open position, the latch bolt 244 is in latching engagement with the strike 24 and serves to hold the door 12 open.

Figure 9:
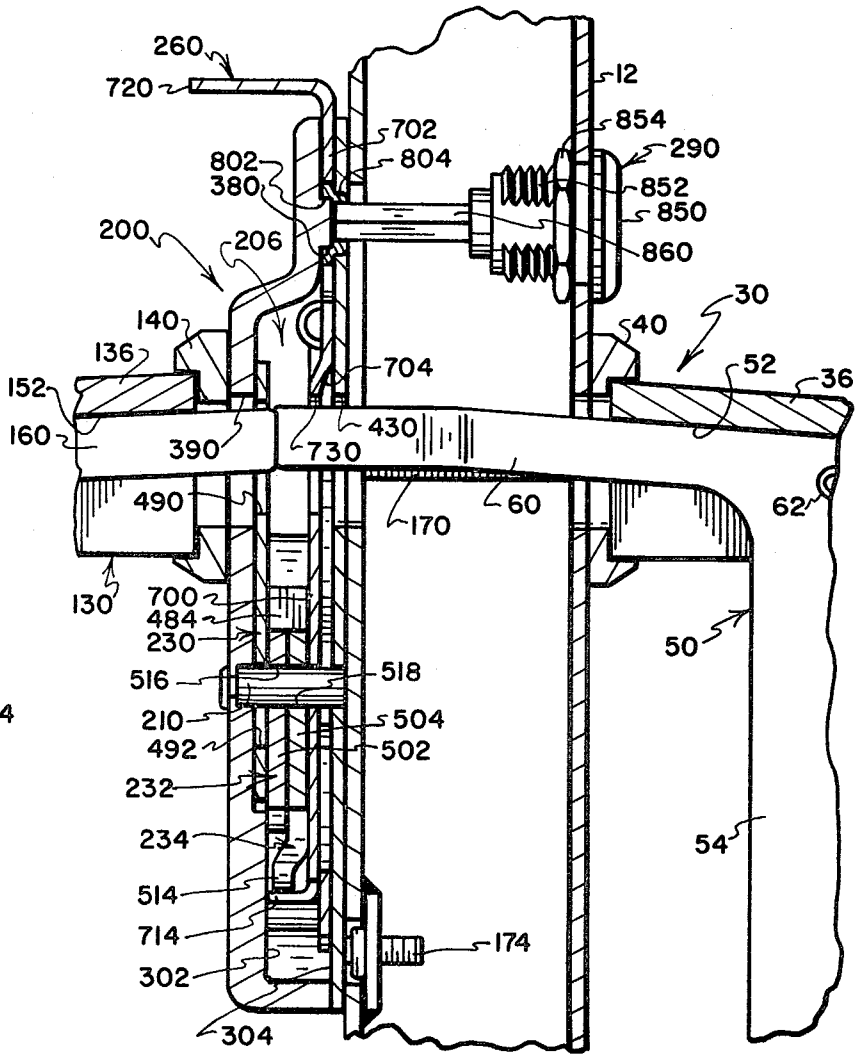
FIGS. 8 and 9 are sectional views on an enlarged scale as seen from planes indicated by lines 6—6 and 7—7 in FIGS. 2 and 1, respectively, with components of the lock unlatched and unlocked.
Figure 11:
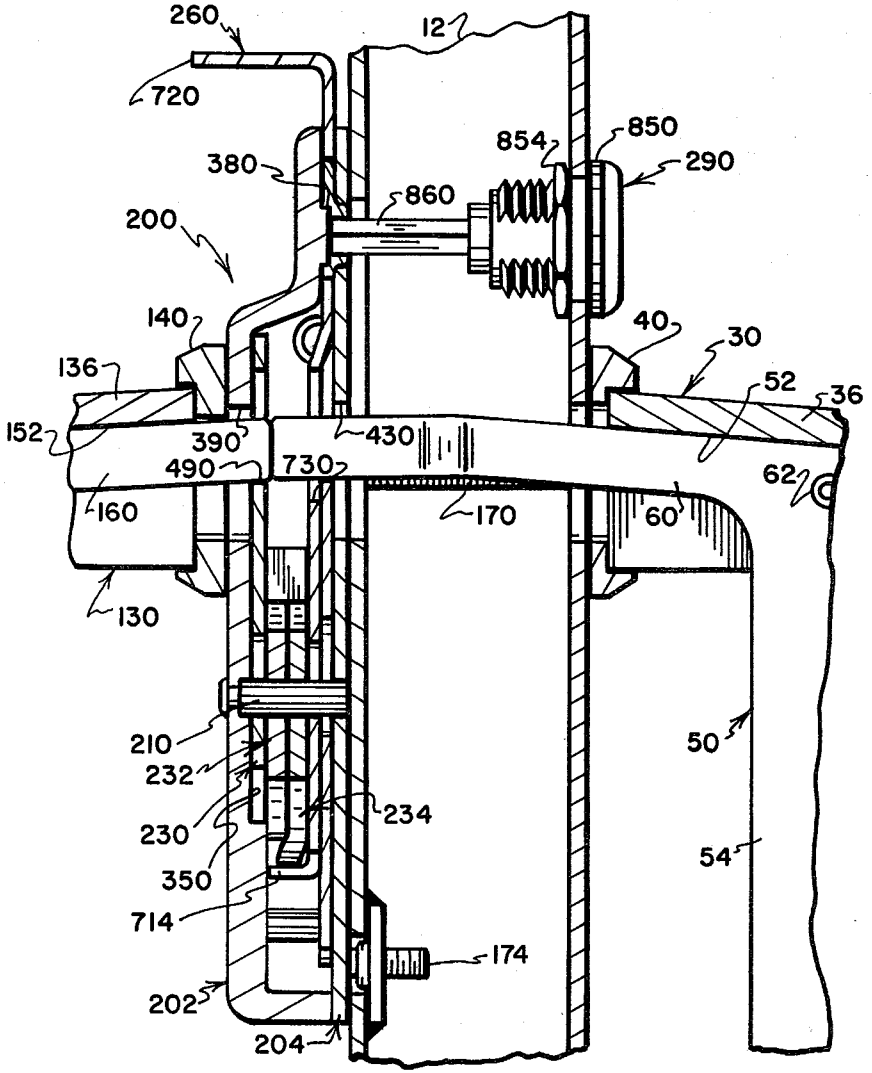
FIGS. 10 and 11 are sectional views similar to FIGS. 6 and 7 with components of the lock latched and locked.
Figure 10:
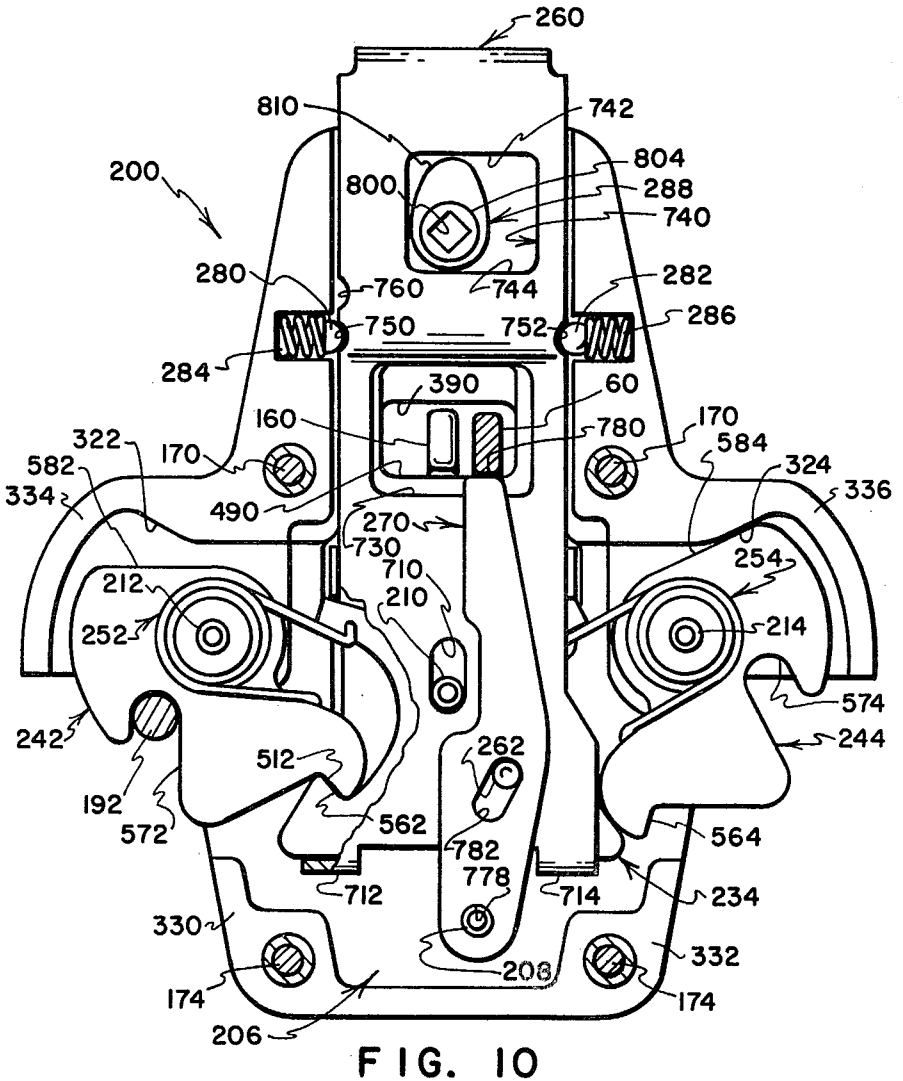

The housing assembly 200 carries a control slide 260 which is movable vertically between a downward, unlocked position shown in FIGS. 2, 3, 8 and 9, and an upward, locked position shown in FIGS. 10 and 11. When the control slide 260 is in its downward, unlocked position, either of the handle assemblies 30, 130 may be operated to release the lock 10 from latched engagement with either of the strikes 22, 24. When the control slide 260 is in its upward, locked position, the exterior handle assembly 30 is inoperative to release the lock 10 from latched engagement with either of the strikes 22, 24, but the interior handle assembly 130 may be operated to simultaneously (1) move the control slide 260 to its downward, unlocked position, and (2) release the lock 10 from latched engagement with either of the strikes 22, 24. Regardless of the position of the various components of the lock 10, the key cylinder 290 may always be operated to effect upward or downward movement of the control slide 260 between its locked and unlocked positions, whereby the lock 10 may always be locked or unlocked from the exterior side of the door 12. Regardless of whether the control slide 260 is in its locked position or its unlocked position, operation of the interior handle assembly 130 is all that is required to release the lock 10 from engagement with either of the strikes 22, 24. Regardless of whether the control slide 260 is in its locked or unlocked position, the lock 10 may be brought into latching engagement with either of the strikes 22, 24, and as latching engagement is established, the control slide 260 is either maintained in or moved to its unlocked position to assure that the operator of the vehicle does not accidentally lock himself out of his vehicle.

The interior and exterior handle assemblies 30, 130 are quite similar in appearance and construction. Referring to FIG. 2, the handle assemblies 30, 130 have U-shaped grips 32, 132 which include upstanding center bars 34, 134, upper legs 36, 136, and lower legs 38, 138. Upper escutcheons 40, 140 connect with the upper legs 36, 136. Lower escutcheons 42, 142, connect with the lower legs 38, 138. The escutcheons 40, 42 of the exterior handle assembly 30 mount directly onto the outer surface of the door 12. The upper escutcheon 140 of the inner handle assembly 130 engages the housing assembly 200. The lower escutcheon 142 of the interior handle assembly 130 engages a spacer block 120 which, in turn, engages the inner surface of the door 12 at a location beneath the housing assembly 200.

The handle assemblies 30, 130 have L-shaped triggers 50, 150 which are carried in hollow channels 52, 152 formed in the U-shaped grips 32, 132. The L-shaped triggers 50, 150 have upstanding gripping portions 54, 154 which extend along the center bars 34, 134, and operating arms 60, 160 which extend along the upper legs 36, 136, through the upper escutcheons 40, 140, and into the housing assembly 200. The handle assemblies 30, 130 have pivot pins 62, 162 positioned in aligned holes formed through the U-shaped grips 32, 132 and through the triggers 50, 150 to pivotally mount the triggers 50, 150 on the U-shaped grips 32, 132. Compression coil springs 64, 164 are interposed between the center bars 34, 134 and the gripping portions 54, 154 to bias the triggers 50, 150 toward the positions shown in FIGS. 2, 9 and 11, whereby the operating arms 60, 160 are likewise biased upwardly toward positions extending closely alongside the upper surfaces of the hollow channels 52, 152 formed in the upper legs 36, 136.

Referring to FIG. 3, mounting bolts 170 extend through aligned holes formed through the upper escutcheon 140 of the interior handle assembly 130, through the housing assembly 200, through the door 12, and thread into blind holes formed in the upper escutcheon 40 of the exterior handle assembly 30. Mounting bolts 172 extend through aligned holes formed through the lower escutcheon 142 of the interior handle assembly 130, through and the spacer 120, and thread into blind holes formed in the lower escutcheon 42 of the exterior handle assembly 30. By this arrangement, the exterior handle assembly 30 is securely blind-mounted on the door 12, and no fasteners are exteriorly exposed. Additional mounting bolts 174 extend through other holes formed in the housing assembly 200 and thread into holes formed in the door 12. This mounting arrangement assures that the lock 10 is securely and easily mounted on the door 12 with its interior and exterior components in proper operating alignment. In essence, the interior and exterior components of the lock 10 are caused to self-align during installation.

Figure 14:
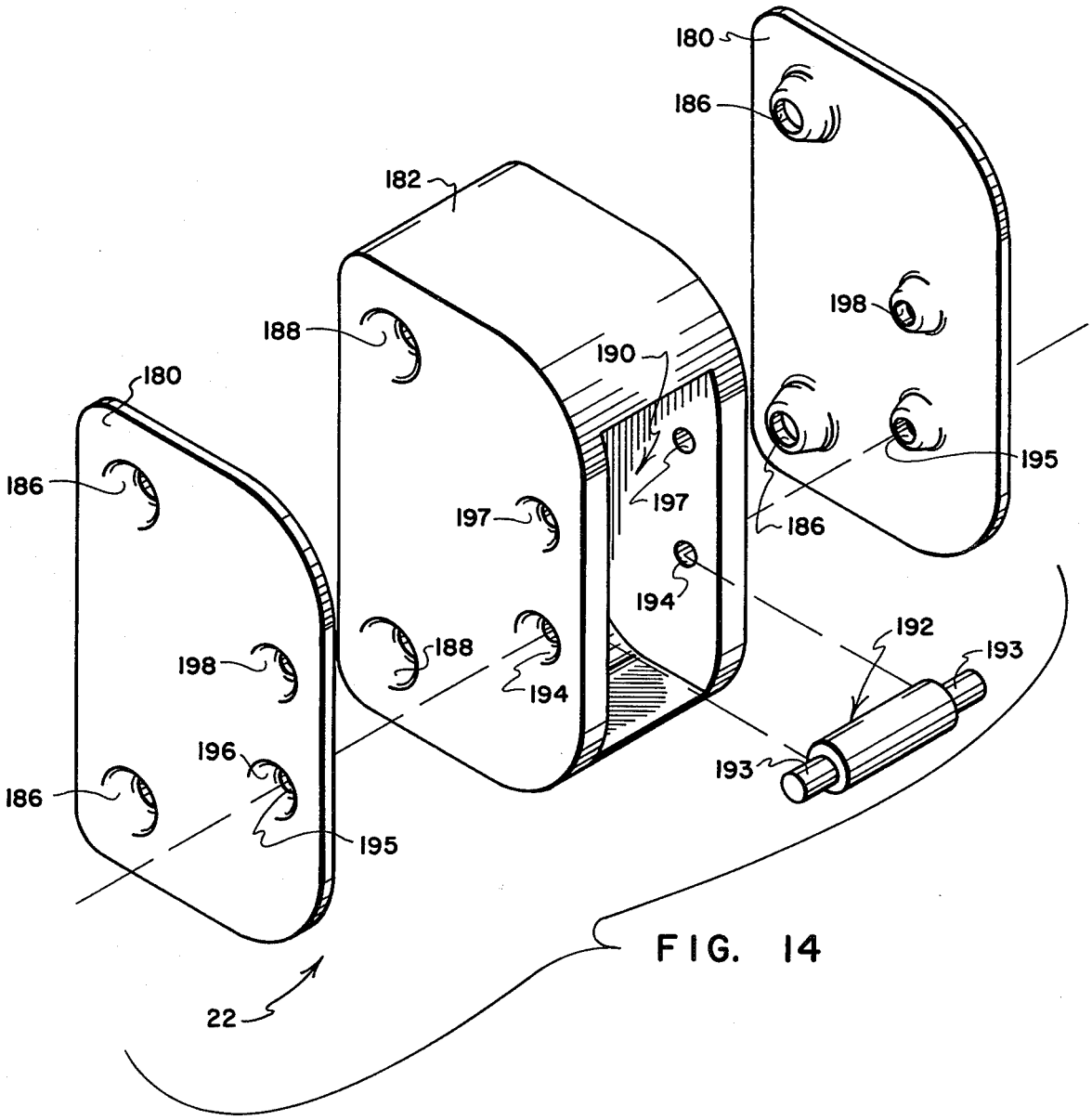

The strikes 22, 24 are identical in construction except that they comprise left and right mirror images of each other; accordingly, only the strike 22 will be described in detail. Referring to FIGS. 3 and 14, the strike 22 includes spaced metal plates 180 of generally rectangular configuration which sandwich a C-shaped bumper block 182 formed of abrasion resistant plastics material, preferably a high-density polyurethane elastomer of the type sold by E. I. DuPont de Nemours & Company under the trademark Adiprene. Mounting bolts 184 extend through holes 186, 188 formed through the plates 180 and the bumper block 182 to mount the strike 22 on the vehicle wall 26. The inner member 182 the defines a generally C-shaped opening 190 which faces toward the lock 10. A striker pin 192 extends through the opening 190 at a location offset below the center of the opening 190. The striker pin 192 has reduced diameter end portions 193 which extend through aligned holes 194, 195 formed through opposite sides of the bumper block 182 and through the plates 180. The end portions 193 are riveted into clamping engagement with recess formations 196 formed in the plates 180. Aligned holes 197, 198 are formed through the plates 180 and the bumper block 182 at a location offset upwardly from the center of the opening 190 to provide an alternate mounting location for the striker pin 192, whereby left and right strikes 22, 24 can be formed using the identical plates 180 and bumper blocks 182 by selectively locating the striker pin 192.

Figure 4:
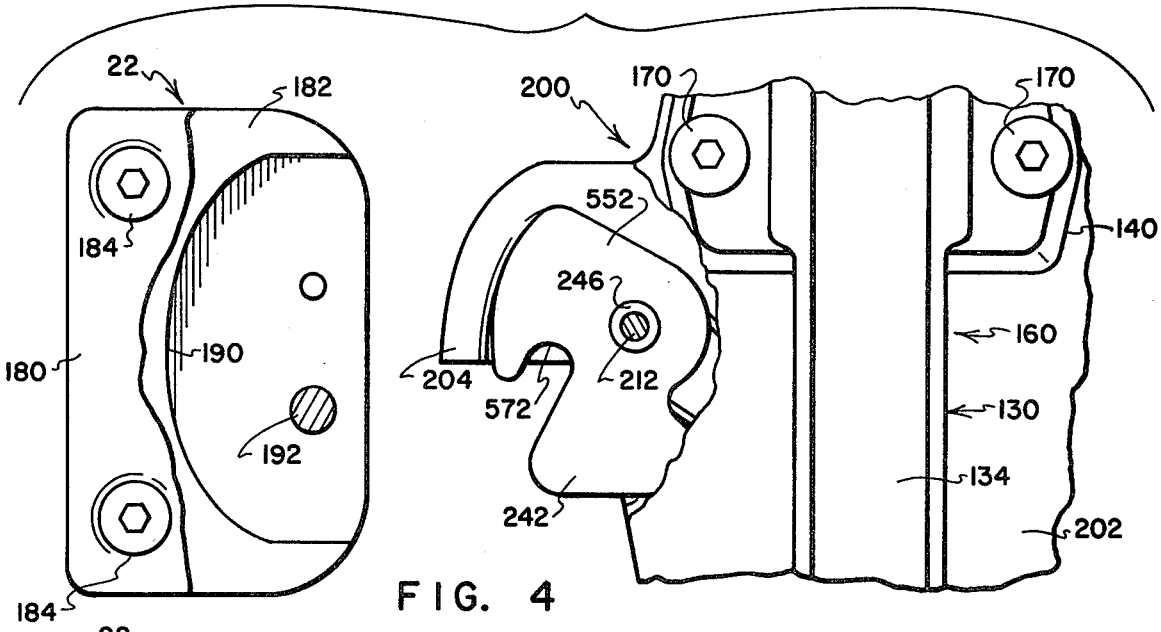
FIGS. 4, 5 and 6 are a series of schematic views on an enlarged scale showing the operation of the lock as one of its latch bolts is brought into latching engagement with a striker pin carried by one of the strikes.
Figure 5:
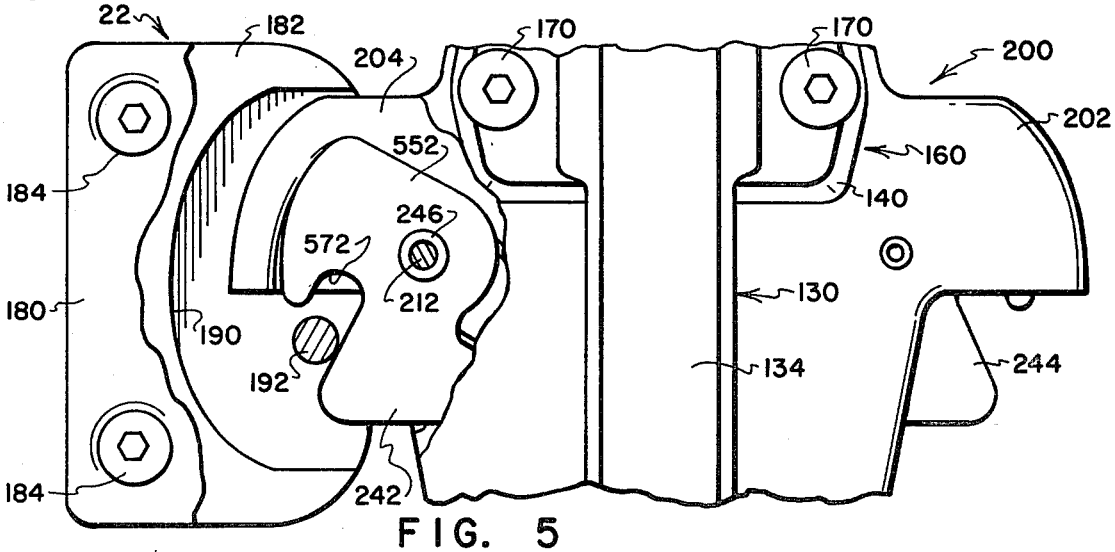
Figure 6:
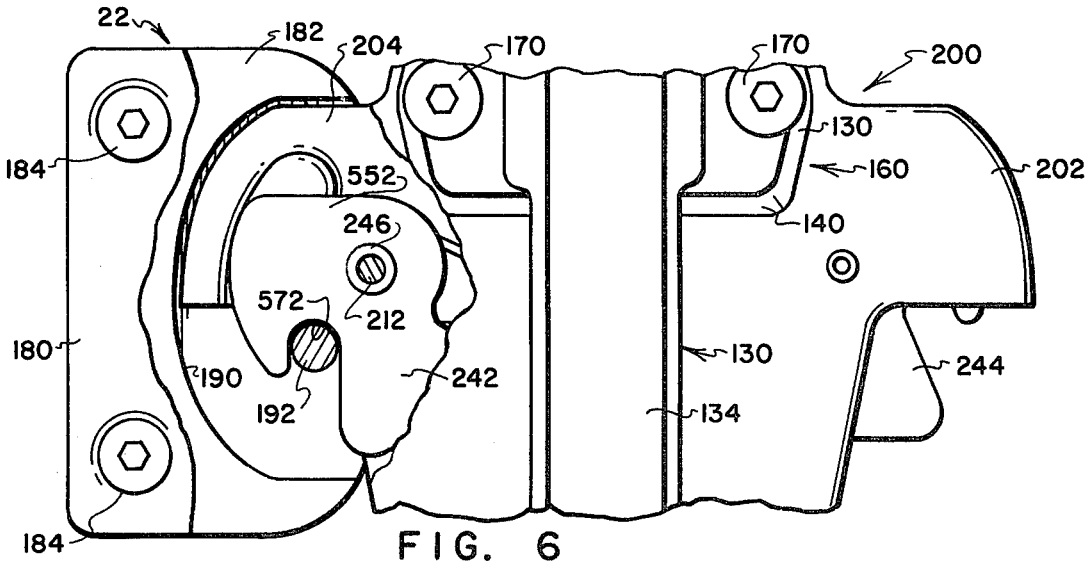

As is best seen in the sequence of views presented by FIGS. 4–6, as the lock 10 moves toward a position of latching engagement with the strike 22, the striker pin 192 engages the rotary latch bolt 242 and rotates the bolt 242 to a position wherein the bolt 242 latchingly engages the striker pin 192. When the latch bolt 242 is in latching engagement with the striker pin 192, as shown in FIG. 6, a portion of the housing assembly 200 is closely nested within the C-shaped opening 190 of the strike 22, and the region of engagement between the latch bolt 242 and the striker pin 192 is protectively enclosed to prevent intrusion. The close-fitting engagement established as portions of the housing assembly 200 are brought into nesting engagement with bumper block surfaces of the strike 22 provides a strong, secure connection which is maintained even under the strain of substantial lateral and transverse loadings.

Figure 7:
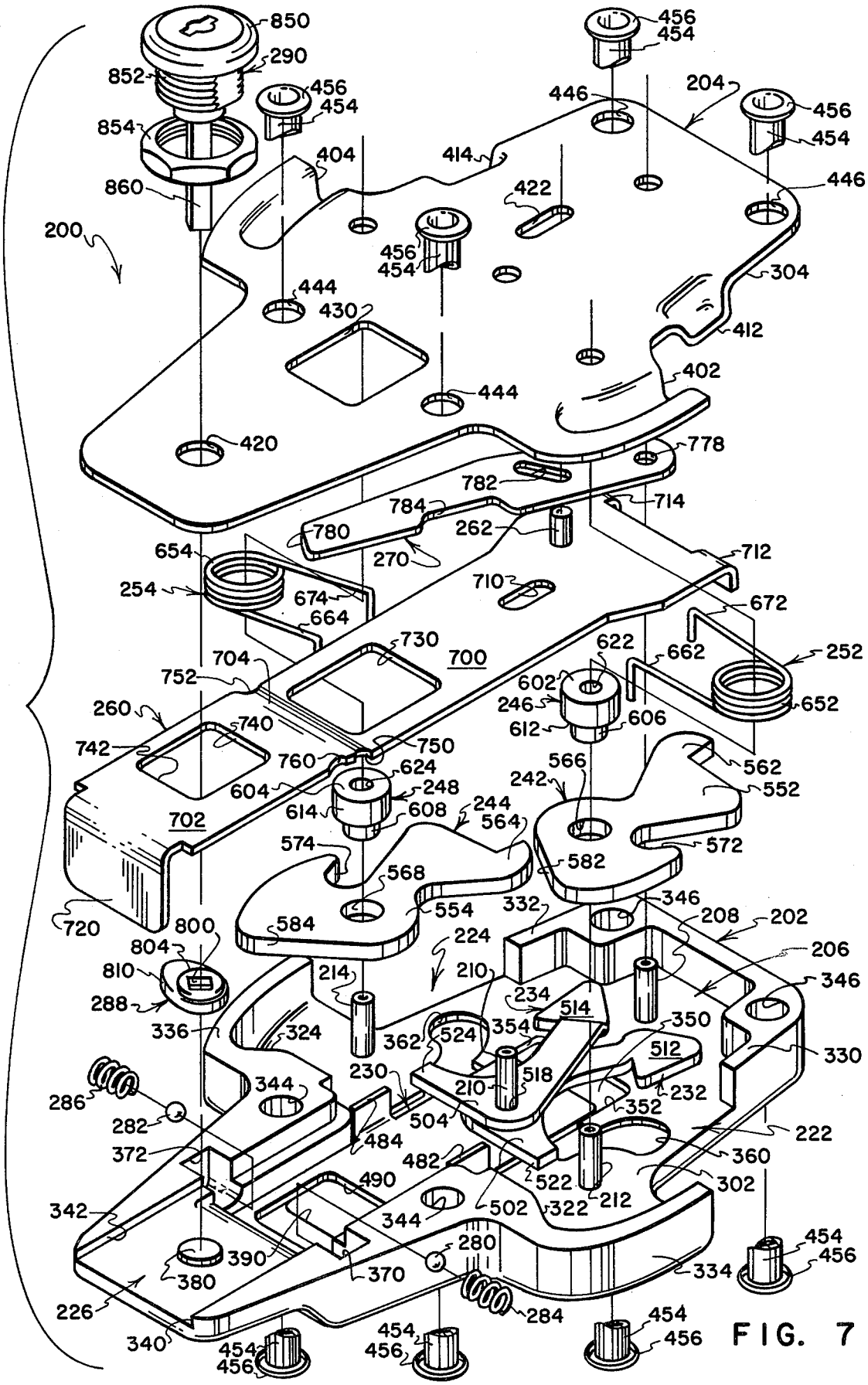
FIG. 7 is an exploded view showing a key cylinder and components of an interior housing assembly of the lock.

Referring to FIG. 7, the housing assembly 200 includes a cast metal case 202 and a stamped metal cover 204 which cooperate to mount and protectively enclose several operating components. The case and cover 202, 204 cooperate to define a chamber 206 having openings 222, 224 on opposite sides thereof. Pins 208, 210, 212, 214 extend through the chamber 206 to engage and mount several operating components which are housed within the chamber 206. These operating components include an operating slide 230, a pair of pawls 232, 234, portions of the latch bolts 242, 244, a pair of mounting bushings 246, 248, a pair of torsion coil springs 252, 254, portions of the control slide 260, and a catch 270.

The case and cover 202, 204 also cooperate to define an elongate slide channel 226 which extends upwardly from the chamber 206 (leftwardly as viewed in FIG. 7). Portions of the control slide 260 extend through the channel 226. Housed along the slide channel 226 are a pair of detent balls 280, 282, a pair of compression coil springs 284, 286 and an operator cam 288.

The case 202 has a flat, inward-facing wall surface 302 which defines one side of the chamber 206. The cover 204 has a flat, inwardly-facing wall surface 304 which defines the opposite side of the chamber 206. The case 202 has raised side wall portions 330, 332, 334, 336 which abuttingly engage the cover surface 304. The wall portions 330, 334 define opposite ends of the opening 222. The wall portions 332, 336 define opposite ends of the opening 224. The wall portions 334, 336 define abutment surfaces 322, 324 which face toward the openings 222, 224. A pair of flat, parallel guide surfaces 340, 342 are formed on the wall portions 334, 336 and extend along opposite sides of the slide channel 226. Mounting holes 344 are formed through the upstanding side wall portions 334, 336 to receive the mounting bolts 170. Mounting holes 346 are formed through the upstanding side wall portions 330, 332 to receive the mounting bolts 174.

A shallow recess 350 is formed in the inwardly-facing wall surface 302 to receive the operating slide 230. A pair of flat, parallel guide surfaces 352, 354 define opposite sides of the recess 350. The guide surfaces 352, 354 parallel the slide channel guide surfaces 340, 342 and serve to guide the movement of the operating slide 230 in vertical directions paralleling the movement of the control slide 260.

A pair of shallow, kidney-shaped recesses 360, 362 are formed in the inwardly-facing wall surface 302 in communication with opposite sides of the recess 350. The recesses 360, 362 provide spaces into which end portions of the torsion coil springs 252, 254 extend, and within which these end portions move during operation of the lock 10.

A pair of aligned recesses 370, 372 are formed in the case 202 at positions along opposite sides of the slide channel 226. The compression coil springs 284, 286 and the detent balls 280, 282 are carried in the recesses 370, 372. The springs 284, 286 bias the balls 280, 282 toward positions of engagement with opposed edge portions of the latch control slide 260.

A cylindrical boss 380 is formed on the case 202 at a position extending into the slide channel 226. The boss 380 extends into a corresponding cylindrical recess 802 (not shown in FIG. 7 but shown in FIG. 9) formed in one face of the latch control operator cam 290 to rotatably mount the cam 290 on the case 202.

A generally rectangular opening 390 is formed through the case 202 at a location along the paths of movement of the operating and control slides 230, 260. The operating arm 160 of the interior handle assembly 130 extends through the opening 390 to effect movement of the operating slide 230, as will be explained.

The cover 204 has two pairs of projections 402, 404 and 412, 414 which extend into the openings 222, 224 to cooperate with the case surface 302 in positioning and guiding the movement of the rotary latch bolts 242, 244. The cover 204 has a hole 420 which opens into the slide channel 226, and an elongate slot 422 which overlies the control slide 260 and parallels the direction of the slide channel 226.

A generally rectangular opening 430 is formed through the cover 204 at a location along the path of movement of the control slide 260. The operating arm 60 of the exterior handle assembly 30 extends through the opening 430 to effect movement of the operating slide 230, as will be explained.

The cover 204 has mounting holes 444, 446 formed therethrough which align with the case mounting holes 344, 346 to receive the mounting bolts 170, 174. Eyelets 454 are positioned in the aligned holes 344, 444 and 346, 446. The eyelets 454 surround mounting bolts 170, 174 and have crimped, headed end regions 456 which clampingly retain the cover 204 in place on the case 202.

Figure 13:
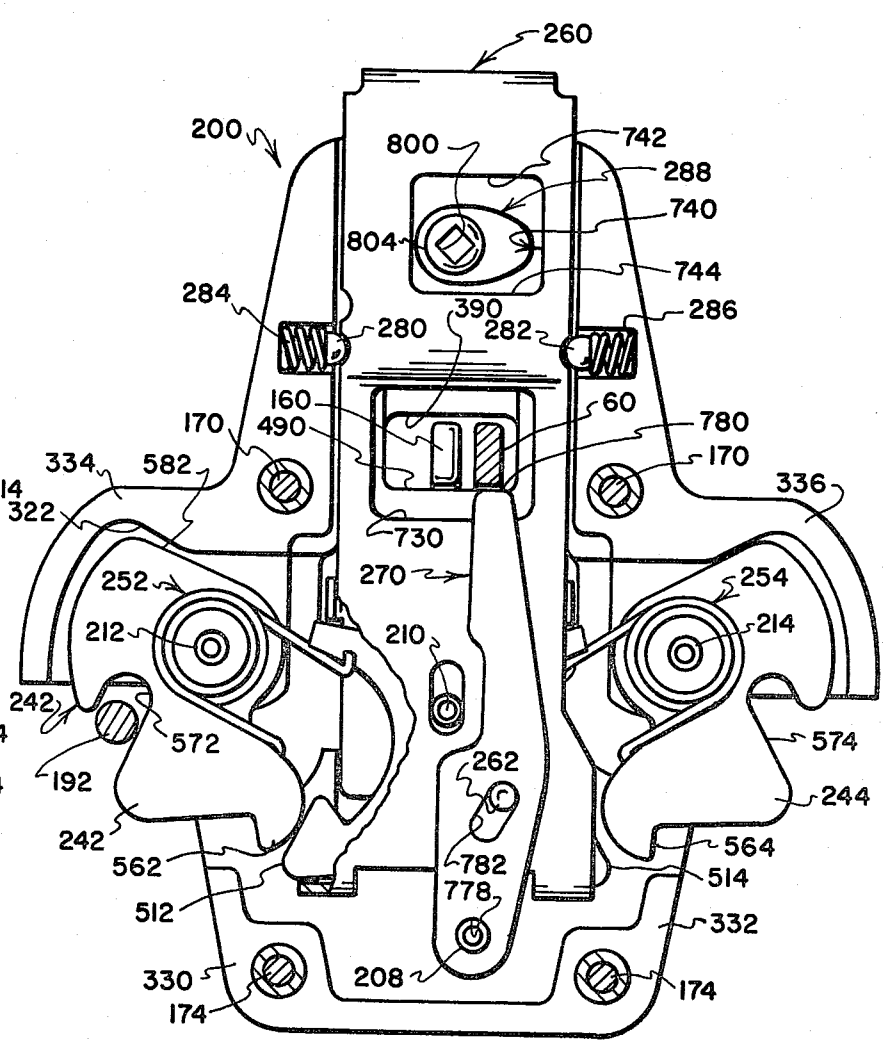
FIG. 13 is a sectional view similar to FIG. 10 illustrating operation of a "slam-override" feature of the lock; and, FIG. 14 is an exploded view showing components of one of the strikes.

The operating slide 230 is the operating element which must be moved downwardly (rightwardly as viewed in FIG. 7) by one of the operating arms 60, 160 to unlatch the lock 10, as will be explained. The operating slide 230 is formed as a stamped metal plate which is flat and lies entirely within the recess 350 except for a pair of stop formations 482, 484 which project into the chamber 206. Referring to FIGS. 9 and 13, a generally rectangular opening 490 is formed through the operating slide 230. The operating arms 60, 160 of the exterior and interior handle assemblies 30, 130 extend through the opening 490 and are engageable with the lower surface of the opening 490 to effect movement of the operating slide 230. Referring to FIG. 9, an elongate slot 492 is formed in the operating slide 230 to receive the pin 210. The slot 292 extends in a direction paralleling the path of travel of the operating slide 230 as defined by the recess 350. The positions of the operating slide 230 in which opposite ends of the slot 292 come into engagement with the pin 210 determine the length of the travel path which can be followed by the operating slide 230.

The pawls 232, 234 are formed as stampings which are left and right mirror images of each other. The pawls 232, 234 have flat, L-shaped mounting portions 502, 504 which carry retaining formations 512, 514. The retaining formations 512, 514 are slightly offset from the planes of the mounting portions 502, 504. Referring to FIGS. 7 and 9, holes 516, 518 are formed through the mounting portions 502, 504 to receive the pin 210, whereby the pawls 232, 234 are pivotally mounted on the pin 210. The mounting portions 502, 504 have ends 522, 524 which are engageable with the slide-carried stops 482, 484.

Figure 8:
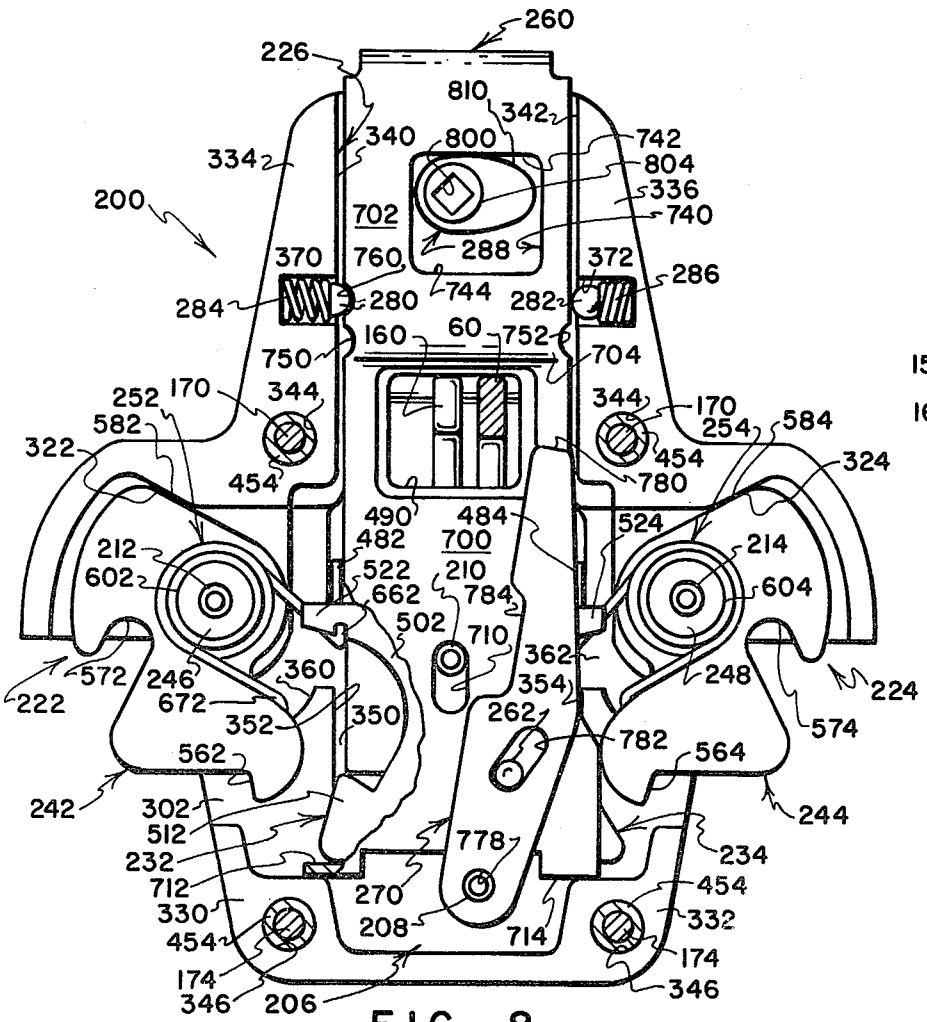

The latch bolts 242, 244 are formed as identical flat stampings. The latch bolts 242, 244 have generally S-shaped mounting portions 552, 554 which carry hook-shaped retaining formations 562, 564 and U-shaped receiving formations 572, 574. Mounting holes 566, 568 are formed through the mounting portions 552, 554 to receive the mounting bushings 246, 248. The bushings 246, 248 journal the latch bolts 242, 244 for rotary movement about the pins 212, 214. Abutment surfaces 582, 584 are provided on the mounting portions 552, 554 for engaging the abutment surfaces 322, 324 formed on the case 102 to define ends of the ranges of rotary movement of the latch bolts 242, 244. When the latch bolts 242, 244 are positioned with their abutment surfaces 582, 584 engaging the case-carried abutment surfaces 322, 324 as shown in FIG. 8, the latch bolts 242, 244 are in their "unlatched" positions. When either of the latch bolts 242, 244 has its retaining formation 562 or 564 engaged by one of the pawl-carried retaining formations 512, 514 (e.g., the position of the latch bolt 242 as shown in FIG. 10), such latch bolt is in its "latched" position.

The mounting bushings 246, 248 have relatively large diameter end portions 602, 604 and relatively smaller diameter end portions 606, 608. Radially extending shoulders 612, 614 join the end portions 602, 606 and 604, 608. Holes 622, 624 are formed through the bushings 246, 248 to receive the pins 212, 214 in a slip fit to journal the bushings 246, 248 on the pins 212, 214. The small end portions 606, 608 are received in a slip fit in the latch bolt mounting holes 566, 568 to journal the latch bolts 242, 244.

The torsion coil springs 252, 254 have coiled central portions 652, 654 and elongate, L-shaped end portions 662, 664, 672, 674. The central portions 652, 654 extend about the large diameter end portions 602, 604 of the mounting bushings 246, 248. The end portions 662, 664 engage the ends 522, 524 of the pawls 232, 234 to bias the pawls 232, 234 toward positions wherein their ends 522, 524 engage the slide-carried stops 482, 484. The end portions 672, 674 engage the latch bolts 242, 244 to bias the latch bolts 242, 244 toward their unlatched positions wherein their abutment surfaces 582, 584 engage the case-carried abutment surfaces 322, 324.

The control slide 260 is formed as a stamped metal plate to which a catch positioning pin 262 is rigidly secured. The control slide 260 is of doglegged configuration, having a flat central portion 700 and a flat guide portion 702 separated by a curved portion 704. The central portion 700 extends through the chamber 206 and carries the catch positioning pin 262. An elongate slot 710 is formed through the central portion 700 to receive the pin 210. The slot 710 extends in a direction paralleling the path of travel of the slide 260. The positions of the control slide 260 wherein opposite ends of the slot 710 come into engagement with the pin 210 determine the length of the travel path of the slide 260.

A pair of hook-shaped pawl-positioning formations 712, 714 are provided on the lower end of the central portion 700 (the right end of the control slide 260 as viewed in FIG. 7). The guide portion 702 extends through the slide channel 226 and has a thumb-engageable operating formation 720 on its upper end (the left end of the control slide 260 as viewed in FIG. 7). A generally rectangular opening 730 is formed through the central portion 702. The opening 730 is of sufficient size to prevent any portion of the control slide 260 from engaging either of the operating arms 60, 160. The operating arm 60 of the exterior handle assembly 30 extends through the opening 730. A generally rectangular opening 740 is formed through the guide portion 702. The opening 740 has upper and end surfaces 742, 744. The opening 740 receives the base-carried boss 380 and houses the operator cam 288. A pair of detent recesses 750, 760 are formed in one side of the curved portion 704 to receive the detent ball 280. A single detent recess 752 is formed in the opposite side of the curved portion 704 to receive the detent ball 282. When the control slide 260 is in its upward, locked position as shown in FIGS. 10 and 11, the detent balls 280, 282 are received in the recesses 750, 752 to securely retain the control slide 260 in its locked position. When the control slide 260 is in its downward, unlocked position as shown in FIGS. 8 and 9, the detent ball 280 is received in the recess 760 to gently retain the control slide 260 in its unlocked position.

The catch 270 is formed as an elongate, flat stamping having a mounting hole 778 near one end thereof. The pin 208 carried by the case 202 extends through the hole 778 to pivotally mount the catch 270. An elongate slot 782 is formed through the catch 270 to receive the positioning pin 262 which is carried by the control slide 260. A notch 784 is formed in one side of the catch 270 to prevent the catch 270 from engaging the pin 210 as the catch is pivoted about the pin 208. A flat stop surface 780 is formed atop the catch 270 (on the left end thereof as viewed in FIG. 7). The catch 270 is pivoted about the pin 208 by virtue of a camming action which takes place as the slide-carried pin 262 is moved in the slot 782. As the control slide 260 moves upwardly (leftwardly as viewed in FIG. 7) toward its locked position, the catch 270 is pivoted to its locked position (shown in FIG. 10) wherein the stop surface 780 underlies the operating arm 60 of the exterior handle assembly 30 its operation, i.e., to prevent actuation of the trigger 50. As the slide 260 moves downwardly (rightwardly as viewed in FIG. 7) toward its unlocked position, the catch 270 is pivoted to its unlocked position (shown in FIG. 8) wherein the stop surface 780 is removed from the path of travel of the operating arm 60 thereby permitting actuation of the trigger 50.

The operator cam 288 is formed as a stamping which has a square hole 800 formed therethrough. Referring to FIG. 9, a cylindrical recess 802 is formed in one side of the cam 288 to receive the case-carried boss 380. Referring to FIGS. 7 and 9, a raised boss 804 is formed on the opposite side of the cam 288 and extends into the cover hole 420. The interfitting engagements of the cam recess 802 with the case boss 380, and the boss 804 with the cover hole 420 journal the cam 288 for rotation relative to the case and cover 202, 204. The cam 288 has an oblong cam surface 810 which is operative to engage the end surface 742 of the opening 740, as is illustrated in FIG. 10, for moving the control slide 260 from its unlocked position (shown in FIG. 8) to its locked position (shown in FIG. 10).

The key cylinder 290 has an enlarged head formation 850 at one end of a threaded mounting cylinder 852. A nut 854 is threaded onto the cylinder 852 and cooperates with the head formation 850 to mount the key cylinder 290 in a hole 856 formed through the outer surface of the door 12. An elongate shank 860 of square cross-section extends from the cylinder 852 through the square hole 800 formed in the operator cam 288. The shank 860 is movable in response to insertion of an appropriately configured key (not shown) into the key cylinder 290 to rotate the operator cam 288. The key cylinder 290 is commercially available from any of a wide variety of suppliers, and is selected to permit 90 degree rotation of the operator cam 288 in either direction from the position shown in FIG. 8, and to permit removal of its key only when the shank 860 has located the cam 288 in the position shown in FIG. 8.

Latching operation of the lock 10 is substantially the same irrespective of whether the latch bolt 242 is being brought into latching engagement with the strike 22, or whether the latch bolt 244 is being brought into latching engagement with the strike 24. Accordingly, only latching of the bolt 242 with the strike 22 will be described. Referring to FIGS. 4–6, as the housing assembly 200 is moved toward the strike 22, the striker pin 192 engages the latch bolt 242 and rotates the latch bolt 242 counterclockwise to its latched position (shown in FIG. 10) wherein the U-shaped receiving formation 572 surrounds and retains the striker pin 192. As the latch bolt 242 reaches its latched position, the pawl 232 is permitted to rotate clockwise under the influence of the spring 252 to a position wherein the retaining formation 512 latchingly engages the retaining formation 562 to hold the bolt 242 in its latched position. If it is desired to lock the lock 10, i.e., to move the control slide 260 upwardly to its locked position whereby the exterior handle assembly 30 cannot be operated to unlatch the lock 10, the key cylinder 290 may be operated from the exterior side of the door 12 to rotate the operator cam 288, as shown in FIG. 10, to move the control slide 260 upwardly; alternatively, the thumb-engageable operating formation 720 on the slide 260 can be directly engaged to pull the slide 260 to its upward, locked position. As the slide 260 is moved to its upward, locked position, the catch 270 is pivoted to the position shown in FIG. 10 wherein the stop surface 780 formed at the end of the catch 270 underlies the operating arm 60 of the exterior handle assembly 30 to prevent downward movement of the operating arm 60, i.e., to prevent operation of the exterior handle assembly 30.

Figure 12:
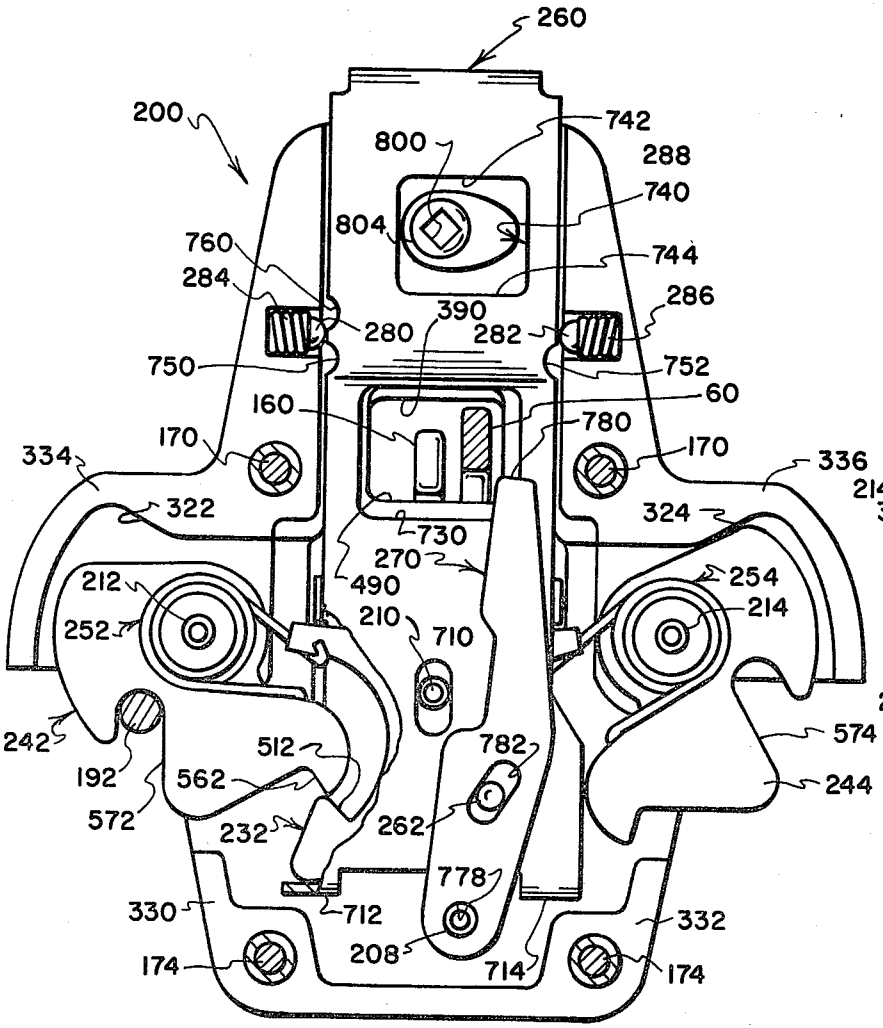
FIG. 12 is a sectional view similar to FIG. 10 illustrating the operation of the lock in response to actuation of the inside handle assembly.

If it is desired to unlock the lock 10, i.e., to move the control slide 260 downwardly from the position shown in FIG. 10 to the position shown in FIGS. 2, 3, 8, and 9, the key cylinder 290 may be operated from the exterior side of the door 12 to rotate the operator cam 288 into engagement with the end surface 744 of the opening 740 to move the control slide 260 downwardly to its unlatched position; alternatively, the thumb-engageable operating formation 720 on the slide 260 can be directly engaged to push the slide 260 downwardly to its unlocked position; alternatively, the inside handle assembly 130 can be operated, as is illustrated in FIG. 12, to cause the operating arm 160 to move the operating slide 230 downwardly. As the operating slide 230 is moved downwardly, its stop formations 482, 484 engage and rotate the pawls 232, 234 to positions wherein the pawl 232 releases the latch bolt 242, and wherein the pawls 232, 234 engage the formations 712, 714 on the control slide 260 whereby the control slide 260 is moved to its unlocked position.

The lock 10 may be unlatched by operating the interior handle assembly 130 regardless of the position of the control slide 260. The lock 10 may be unlatched by operating the exterior handle assembly 30 only when the lock control slide 260 is in its unlocked position. Unless the control slide 260 is in its unlatched position, the catch 270 blocks the path of travel of the operating arm 60 of the exterior handle assembly 30.

A feature of the lock 10, known in the art as a "slam override" feature, enables either of the latch bolts 242, 244 to be rotated into latching engagement with striker pins 192 carried in the strikes 22, 24, even when the control slide 260 is in its upward, locked position. By way of example, FIG. 13 depicts the latch bolt 242 in the process of being brought into engagement with the striker pin 192 at a time when the control slide 260 is in its upward, locked position. As the striker pin 192 engages the latch bolt 242, the latch bolt 242 is caused to rotate counterclockwise. As the bolt 242 rotates counterclockwise, the hook-shaped retaining formation 512 engages the hook-shaped retaining formation 562, and a camming action operating between these engaged formations causes the pawl 232 to rotate counterclockwise in opposition to the spring 252. As the pawl 232 rotates counterclockwise, its retaining formation 512 engages the pawl-positioning formation 712 on the end of the control slide 260, causing the control slide 260 to be moved downwardly to its unlocked position. Continued counterclockwise rotation of the bolt 242 and the pawl 232 bring the bolt 242 and pawl 232 to positions wherein latching engagement is established between the bolt 242 and the striker pin 192, as shown in FIG. 10.

While orientation terminology such as the words "top," "bottom," "upward," "downward," "exterior," and "interior" are utilized herein, it will be understood that locks embodying features of the present invention may be positioned in attitudes which are different than the orientation illustrated in the drawings and described herein. Accordingly, it will be understood that terms of this character are utilized herein simply to facilitate an understanding of the relative orientation and arrangement of various components, and are not to be construed as limiting.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock, comprising:

(a) housing means for mounting on a sliding door for movement with the door along a path of travel between a first position wherein the door closes an access opening, and a second position wherein the door provides access through the opening;

(b) first and second strike means for mounting at spaced positions along the path of travel on opposite sides of the access opening;

(c) first and second rotary latch bolt means carried by the housing means near opposite sides thereof, the first rotary latch bolt means being operable to latchingly engage the first strike means when the door is in its first position, and the second rotary latch bolt means being operable to latchingly engage the second strike means when the door is in its second position;

(d) exterior operator means for mounting on an exterior side of the door;

(e) interior operator means for mounting on an interior side of the door;

(f) lock control means carried by the housing means for movement between locked and unlocked positions; and, (g) operating means carried by the housing means for connecting with the first and second rotary latch bolt means, with the exterior operator means, with the interior operator means, and with the lock control means for:

(i) enabling the interior operator means to be operated to release each of the first and second rotary latch bolt means from latching engagement with an associated one of the first and second strike means regardless of the position of the lock control means;

(ii) moving the lock control means from its locked position to its unlocked position in response to operation of the interior operator means when the lock control means is in its locked position;

(iii) enabling the exterior operator means to be operated to release each of the first and second rotary latch bolt means from latching engagement with an associated one of the first and second strike means when the lock control means is in its unlocked position;

(iv) preventing the exterior operator means from being operated to release either of the first and second rotary latch bolt means from latching engagement with an associated one of the first and second strike means when the lock control means is in its locked position; and, (v) moving the lock control means from its locked position to its unlocked position in response to either of the first and second rotary latch bolt means being brought into latching engagement with an associated one of the first and second strike means when the lock control means is in its locked position.

2. The door lock of claim 1 additionally including key-operated means positioned to be accessible from the exterior side of the door and connected through the operating means to the lock control means for moving the lock control means selectively between its locked and unlocked positions in response to operation of the key-operated means.

3. The door lock of claim 2 wherein:

(a) the operating means includes cam means movably supported by the housing means and connected to the lock control means for moving the lock control means from its unlocked position to its locked position when the cam means is moved in a first direction of movement, and for moving the lock control means from its locked position to its unlocked position when the cam means is moved in a second direction of movement; and, (b) the key-operated means connects with the cam means for selectively moving the cam means in the first and second directions of movement in response to operation of the key-operated means.

4. The door lock of claim 3 wherein the housing means mounts the cam means for rotary movement in opposed first and second directions of rotation, and the key-operated means includes an elongate stem which connects with the cam means for rotating the cam means.

5. The door lock of claim 1 wherein the housing means includes a case and a cover which cooperate to define a chamber within which portions of the operating means are positioned.

6. The door lock of claim 5 wherein:

(a) the case and the cover have first portions which cooperate to define a first opening, and second portions which cooperate to define a second opening, the first and second openings being located on opposite sides of the housing means and communicating with the chamber;

(b) the first rotary latch bolt means has a mounting portion positioned in the chamber at a location near the first opening;

(c) the second rotary latch bolt means has a mounting portion positioned in the chamber at a location near the second opening;

(d) first and second pins extend through aligned holes formed in the case and cover and through the chamber to define first and second axes of rotation for the first and second rotary latch bolt means;

(e) the mounting portions of the first and second latch bolt means are connected to the first and second pins, respectively, to mount the first and second latch bolt means for pivotal movement about the first and second axes, respectively, between latched and unlatched positions;

(f) the first rotary latch bolt means has a first strike-receiving formation which extends through the first opening for:
(i) engaging the first strike means as the housing means and the first strike means are moved relatively toward each other, and for effecting rotation of the first latch bolt means from its unlatched position to its latched positioning response to such movement;
(ii) establishing latching engagement between the first rotary latch bolt and the first strike means when the first strike means has effected rotation of the first latch bolt means to its latched position; and,
(g) the second rotary latch bolt means has a second strike-receiving formation which extends through the second opening for:
(i) engaging the second strike means as the housing means and the second strike means are moved relatively toward each other, and for effecting rotation of the second latch bolt means from its unlatched position to its latched position in response to such movement;
(ii) establishing latching engagement between the second rotary latch bolt and the second strike means when the second strike means has effected rotation of the second latch bolt means to its latched position.

7. The door lock of claim 6 wherein:
(a) the first strike means includes structure defining a first cavity opening toward the housing means, and a first striker pin extending through the first cavity for engagement with the first rotary latch bolt means; and,
(b) the second strike means includes structure defining a second cavity opening toward the housing means, and a second striker pin extending through the second cavity for engagement with the second rotary latch bolt means.

8. The door lock of claim 7 wherein:
(a) the first portions of the case and cover are configured to be closely nestingly received within the first cavity when the first rotary latch bolt means latchingly engages the first striker pin; and,
(b) the second portions of the case and cover are configured to be closely nestingly received within the second cavity when the second rotary latch bolt means latchingly engages the second striker pin.

9. The door lock of claim 7 wherein:
(a) the first portions of the case and cover cooperate with the first strike means to protectively enclose a region of engagement wherein the first rotary latch bolt means engages the first striker pin when the first rotary latch bolt means is latchingly engaging the first striker pin; and,
(b) the second portions of the case and cover cooperate with the second strike means to protectively enclose a region of engagement of the second rotary latch bolt means engages the second striker pin when the second rotary latch bolt means is latchingly engaging the second striker pin.

10. The door lock of claim 1 wherein:
(a) the first rotary latch bolt means is supported by the housing means for rotary movement about a first axis between latched and unlatched positions;
(b) the second rotary latch bolt means is supported by the housing means for rotary movement about a second axis between latched and unlatched positions; and,
(c) the operating means includes biasing means biasing the first and second rotary latch bolt means toward their unlatched positions.

11. The door lock of claim 10 wherein:
(a) the housing means defines a chamber within which portions of the operating means are positioned;
(b) the housing means carries first and second pins which extend through the chamber and define the first and second axes, respectively; and,
(c) the biasing means includes a first torsion coil spring biasing the first rotary latch bolt means toward its unlatched position, and a second torsion coil spring biasing the second rotary latch bolt means toward its unlatched position.

12. The door lock of claim 10 wherein the operating means includes a first bushing carried on the first pin and mounting the first rotary latch bolt means for rotation about the first axis, and a second bushing carried on the second pin and mounting the second rotary latch bolt means for rotation about the second axis.

13. The door lock of claim 12 wherein the biasing means includes a first torsion coil spring having a first coiled portion which extends about the first bushing, and a second torsion coil spring having a second coiled portion which extends about the second bushing.

14. The door lock of claim 10 wherein:
(a) the operating means additionally includes first and second pawl means, each being movable between latched and unlatched positions;
(b) the first pawl means being operative to latchingly engage the first rotary latch bolt means to releasably retain the first rotary latch bolt means in its latched position; and,
(c) the second pawl means being operative to latchingly engage the second rotary latch bolt means to releasably retain the second rotary latch bolt means in its latched position.

15. The door lock of claim 14 wherein the housing means carries a third pin which extends through the chamber and defines a third axis of rotation, and the first and second pawl means are connected to the third pin for rotation about the third axis.

16. The door lock of claim 14 wherein the biasing means is additionally operative to bias the first and second pawl means toward their latched positions.

17. The door lock of claim 16 wherein:
(a) the biasing means includes first and second torsion coil springs;
(b) the first torsion coil spring biases the first rotary latch bolt means toward its unlatched position, and biases the first pawl means toward its latched position; and,
(c) the second torsion coil spring biases the second rotary latch bolt means toward its unlatched position, and biases the second pawl means toward its latched position.

18. The door lock of claim 17 wherein:
(a) the first torsion coil spring has a coiled portion which extends about the first axis, one end portion which engages the first rotary latch bolt means, and another end portion which engages the first pawl means; and,
(b) the second torsion coil spring has a coiled portion which extends about the second axis, one end portion which engages the second rotary latch bolt means, and another end portion which engages the second pawl means.

19. The door lock of claim 14 wherein the operating means includes formation means on the first and second rotary latch bolt means, on the first and second pawl means, and on the lock control means for effecting movement of the lock control means from its locked position to its unlocked position in response to either of the first and second rotary latch bolt means being brought into latching engagement with an associated one of the first and second strike means when the lock control means is in its locked position.

20. The door lock of claim 19 wherein the formation means includes:

(a) engageable formation means on the first rotary latch bolt means and on the first pawl means for effecting rotation of the first pawl means about the third axis in response to rotation of the first rotary latch bolt means about the first axis as the first rotary latch bolt is being moved to a position of latching engagement with the first strike means;

(b) engageable formation means on the second rotary lock bolt means and on the second pawl means for effecting rotation of the second pawl means about the third axis in response to rotation of the second rotary lock bolt means about the second axis as the second rotary lock bolt is being moved to a position of latching engagement with the second strike means (c) engageable formation means on the first pawl means and on the lock control means for moving the lock control means from its locked position to its unlocked position in response to said rotation of the first pawl means about the third axis; and, (d) engageable formation means on the second pawl means and on the lock control means for moving the lock control means from its locked position to its unlocked position in response to said rotation of the second pawl means about the third axis.

21. The door lock of claim 14 wherein:

(a) the operating means includes an operating slide which is movable from a latched position to an unlatched position in response to operation to either of the interior and exterior operator means;

(b) the operating slide is engageable with the first and second pawl means for moving he first and second pawl means from their latched positions to their unlatched positions in response to movement of the operating slide from its latched position to its unlatched position; and, (c) the biasing means is operative to bias the operating slide toward its latched position.

22. The door lock of claim 21 wherein:

(a) the operating slide carries an operating formation;

(b) the exterior and the interior operator means each have separate operating arms which are movable along separate paths of travel from a normal position to an operating position, and are operable during such movement to engage the operating formation and to move the operating slide from its latched position to its unlatched position.

23. The door lock of claim 22 wherein:

(a) the exterior and interior operator means each carry separate biasing means for biasing their respective operating arms toward their respective normal positions.

24. The door lock of claim 22 wherein the operating means includes catch means which is movable between a locked position out of the patch of travel of the operating arm of the exterior operator means, and an unlocked position blocking movement of the operating arm of the exterior operator means to selectively permit and prevent operation of the exterior operator means.

25. The door lock of claim 1 wherein the operating means includes catch means which is movable between a locked position and an unlocked position for selectively permitting and preventing operation of the exterior operator means.

26. The door lock of claim 25 wherein:

(a) the interior and exterior operator means have operating arms which extend through openings formed through the housing means and into a chamber defined by the housing means;

(b) each of the operating arms is movable within the chamber along a separate path of travel; and, (c) the catch means is operative to block the path of travel of the operating of the exterior operator means when the catch means is in its locked position, whereby the exterior operator means is prevented from releasing either of the first and second rotary latch both means from latching engagement with an associated one of the first and second strike means.

27. The door lock of claim 26 wherein the catch means is connected to the lock control means for movement:

(a) from its locked position to its unlocked position in response to movement of the lock control means from its locked position to its unlocked position; and, (b) from its unlocked position to its locked position in response to movement of the lock control means from its unlocked position to its locked position.

28. The door lock of claim 27 wherein:

(a) the lock control means carries a positioning pin;

(b) the catch means has a receiving formation which engages the positioning pin and is configured to cooperate with the positioning pin to effect movement of the catch means in response to movement of the lock control means.

29. The door lock of claim 1 wherein the lock control means includes a lock control slide carried by the housing means for movement along a path of travel between locked and unlocked positions, and the operating means includes detent means for releasably retaining the lock control slide in its locked and unlocked positions.

30. The door lock of claim 29 wherein:

(a) the interior and exterior operator means have operating arms which extend through openings formed through the housing means and into a chamber defined by the housing means;

(b) each of the operating arms is movable within the chamber along a separate path of travel; and, (c) the lock control slide has an opening formed therethrough which is of sufficient size to permit the operating arm of the exterior operator means to pass there-through without engaging any portion of the lock control slide.

31. The door lock of claim 1 wherein:

(a) the housing means includes a case and a cover which cooperate to define a chamber within which portions of the operating means are housed, and which cooperate to form a guide channel which extends along at least a portion of the path of travel of the lock control slide; and, (b) the lock control slide extends from the chamber through the guide channel and projects out of the housing assembly to provide an operator-engageable formation which can be engaged by an operator to move the lock control slide between its locked and unlocked positions.

32. The door lock of claim 1 wherein each of the first and second strike means comprises structure defining a substantially C-shaped opening facing toward the housing means, and the housing means has opposite side portions configured to be nestingly engaged within a selected one of the C-shaped openings when either of the latch bolt means is latchingly engaging an associated one of the first and second strike means.

33. A strike for latchingly engaging a lock bolt, comprising:

(a) a bumper block formed from plastics material, the bumper block having an end surface and a pair of spaced side surfaces extending transverse to the end surface;

(b) a cavity formed in the bumper block and opening through the ends surface;

(c) mounting means including first and second structures for sandwiching the bumper block therebetween with each of the structures engaging a separate one of the side surfaces;

(d) aligned holes formed through the bumper block and through the first and second structures; and, (e) an elongate striker pin positioned in the aligned holes and extending through the cavity at a first location defined by the aligned holes, the pin having a pair of opposed end regions each of which is rigidly connected to a separate one of the first and second structures.

34. The strike of claim 33 wherein:

(a) the bumper block and the cavity defined by the bumper block are symmetrical about an imaginary plane extending substantially centrally through the cavity;

(b) the aligned holes are formed at a location offset from the imaginary plane, whereby the striker pin is positioned to extend through the cavity at a location offset to one side of the imaginary plane; and, (c) additional aligned holes are formed through the bumper block and through the first and second structures to provide an alternate location for the striker pin, the alternate location and the first location being symmetrical with respect to the imaginary plane.

35. The strike of claim 34 wherein the first and second structures are of identical configuration.

36. The strike of claim 35 wherein the identical first and second structures comprise metal plates.

37. The strike of claim 36 wherein the striker pin has a relatively large diameter central portion which extends through the cavity, and relatively smaller diameter end regions extending into the holes formed in the metal plates.

38. The strike of claim 33 additionally including aligned mounting holes formed through the bumper block and through the first and second structures along a common axis which does not extend through the cavity.

39. A latch and strike, comprising:

(a) a latch housing having a projecting portion on one side thereof;

(b) a rotary latch bolt carried by the housing and projecting outwardly from the projecting portion for latchingly engaging a striker pin;

(c) a strike including:

(i) a bumper block formed from rigid plastics material, the bumper block having a end surface and a pair of spaced side surfaces extending transverse to the end surface;

(ii) a cavity formed in the bumper block configured to nestingly receive the projecting portion of the latch housing and such parts of the latch bolt as project therefrom;

(iii) mounting means including first and second structures for sandwiching the bumper block therebetween with each of the structures engaging a separate one of the side surfaces;

(iv) aligned holes formed through the bumper block and through the first and second structures; and, (v) an elongate striker pin positioned in the aligned holes and extending through the cavity at a first location defined by the aligned holes, the pin having a pair of opposed end regions each of which is rigidly connected to a separate one of the first and second structures; and, (d) the cavity being configured such that, when the latch bolt latchingly engages the striker pin, the latch housing and the strike cooperate to protectively shield the region of engagement of the latch bolt and the striker pin.

40. The latch and strike of claim 39 wherein the projecting portion of the housing and portions of the bumper block which define the cavity are configured to closely, nestingly engage when the cavity being configured such that, when the latch bolt latchingly engages the striker pin, the latch housing and the strike cooperate to protectively shield the region of engagement of the latch bolt and the striker pin.

41. A door lock, comprising:

(a) housing means for mounting on a sliding door for movement with the door along a path of travel between a first position wherein the door closes an access opening, and a second position wherein the door provides access through the opening;

(b) first and second strike means for mounting at spaced positions along the path of travel on opposite sides of the access opening;

(c) first and second rotary latch bolt means carried by the housing means near opposite sides thereof, the first rotary latch bolt means being operable to latchingly engage the first strike means when the door is in its first position, and the second rotary latch bolt means being operable to latchingly engage the second strike means when the door is in its second position;

(d) exterior operator means for mounting on an exterior side of the door, the exterior operator means having an operating arm which is movable along a path of travel between a normal position and an operating position, and biasing means biasing its operating arm toward its normal position;

(e) interior operator means for mounting on an interior side of the door, the interior operator means having an operating arm which is movable along a path of travel between a normal position and an operating position, and biasing means biasing its operating arm toward its normal position;

(f) lock control means carried by the housing means for movement between locked and unlocked positions; and, (g) operating means carried by the housing means, including:

(i) key-operated means positioned to be accessible from the exterior side of the door and connected to the lock control means for moving the lock control means selectively between its locked and unlocked positions in response to operation of the key-operated means;

(ii) first and second pawl means each being movable between latched and unlatched positions, the first pawl means being operative to latchingly engage the first rotary latch bolt means to releasably retain the first rotary latch bolt means in its latched position, the second pawl means being operative to latchingly engage the second rotary latch bolt means to releasably retain the second rotary latch bolt means in its latched position;

(iii) formation means on the first and second rotary latch bolt means, on the first and second pawl means, and on the lock control means for effecting movement of the lock control means from its locked position to its unlocked position in response to either of the first and second rotary latch bolt means being brought into latching engagement with an associated one of the first and second strike means when the lock control means is in its locked position;

(iv) an operating slide which is engageable with the operating arms of the exterior and interior operator means, and which is movable from a latched position to an unlatched position in response to movement of either of the operating arms of the interior and exterior operator means from its normal position to its operating position, the operating slide being engageable with the first and second pawl means for moving the first and second pawl means from their latched positions to their unlatched positions in response to movement of the operating slide from its latched position to its unlatched position; and, (v) catch means which is movable between a locked position out of the path of travel of the operating arm of the exterior operator means, and an unlocked position blocking movement of the operating arm of the exterior operator means for selectively permitting and preventing movement of the operating arms of the exterior operator means from its normal position to its operating position, the catch means being connected to the lock control means and being movable (1) from its locked position to its unlocked position in response to movement of the lock control means from its locked position to its unlocked position, and, (2) from its unlocked position to its locked position in response to movement of the lock control means from its unlocked position to its locked position.

42. The door lock of claim 41 additionally including key-operated means positioned to be accessible from the exterior side of the door and being connected to the lock control means for moving the lock control means selectively to its locked and unlocked positions in response to operation of the key-operated means.

43. The door lock of claim 42 wherein:

(a) the operating means includes cam means movably supported by the housing means and connected to the lock control means for moving the lock control means from its unlocked position to its locked position when the cam means is moved in a first direction of movement, and for moving the lock control means from its locked position to its unlocked position when the cam means is moved in a second direction of movement; and, (b) the key-operated means connects with the cam means for selectively moving the cam means in the first and second directions of movement in response to operation of the key-operated means.

44. The door lock of claim 41 wherein:

(a) the housing means defines a chamber and has first and second openings formed on opposite sides thereof which communicate with the chamber;

(b) the first rotary latch bolt means has a mounting portion positioned in the chamber at a location near the first opening;

(c) the second rotary latch bolt means has a mounting portion positioned in the chamber at a location near the second opening;

(d) first and second pins extend through aligned holes formed in the case and cover and through the chamber to define first and second axes of rotation for the first and second rotary latch bolt means;

(e) the mounting portions of the first and second latch bolt means are connected to the first and second pins, respectively, to mount the first and second latch bolt means for pivotal movement about the first and second axes, respectively, between latched and unlatched positions;

(f) the first rotary latch bolt means has a first strike-receiving formation which extends through the first opening for:

(i) engaging the first strike means as the housing means and the first strike means are moved relatively toward each other, and for effecting rotation of the first latch bolt means from its unlatched position to its latched positioning response to such movement;

(ii) establishing latching engagement between the first rotary latch bolt and the first strike means when the first strike means has effected rotation of the first latch bolt means to its latched position; and, (g) the second rotary latch bolt means has a second strike-receiving formation which extends through the second opening.

45. The door lock of claim 44 wherein:

(a) the first strike means includes structure defining a first cavity opening toward the housing means, and a first striker pin extending through the first cavity for engagement with the first rotary latch bolt means; and, (b) the second strike means includes structure defining a second cavity opening toward the housing means, and a second striker pin extending through the second cavity for engagement with the second rotary latch bolt means.

46. The door lock of claim 45 wherein:

(a) the housing means has first portions which define the first opening, and second portions which define the second opening;

(b) the first portions are configured to be closely nestingly received within the first cavity when the first rotary latch bolt means latchingly engages the first striker pin; and, (c) the second portions are configured to be closely nestingly received within the second cavity when the second rotary latch bolt means latchingly engages the second striker pin.

47. The door lock of claim 46 wherein:

(a) the first portions cooperate with the first strike means to protectively enclose a region of engagement wherein the first rotary latch bolt means engages the first striker pin when the first rotary latch bolt means is latchingly engaging the first striker pin; and, (b) the second portions cooperate with the second strike means to protectively enclose a region of engagement of the second rotary latch bolt means engages the second striker pin when the second rotary latch bolt means is latchingly engaging the second striker pin.

48. The door lock of claim 41 wherein the operating means additionally includes biasing means for biasing the first and second rotary latch bolt means toward their unlatched positions.

49. The door lock of claim 41 wherein the operating means additionally includes biasing means biasing the first and second pawl means toward their latched positions.

50. The door lock of claim 41 wherein the formation means includes:

(a) engageable formation means on the first rotary latch bolt means and on the first pawl means for effecting rotation of the first pawl means about the third axis in response to rotation of the first rotary latch bolt means about the first axis as the first rotary latch bolt is being moved to a position of latching engagement with the first strike means;

(b) engageable formation means on the second rotary lock bolt means and on the second pawl means for effecting rotation of the second pawl means about the third axis in response to rotation of the second rotary lock bolt means about the second axis as the second rotary lock bolt is being moved to a position of latching engagement with the second strike means;

(c) engageable formation means on the first pawl means and on the lock control means for moving the lock control means from its locked position to its unlocked position in response to said rotation of the first pawl means about the third axis; and, (d) engageable formation means on the second pawl means an on the lock control means for moving the lock control means from its locked position to its unlocked position in response to said rotation of the second pawl means about the third axis.

51. The door lock of claim 41 wherein:

(a) the lock control means carries a positioning pin;

(b) the catch means has a receiving formation which engages the positioning pin and is configured to cooperate with the positioning pin to effect movement of the catch means in response to movement of the lock control means.

52. The door lock of claim 41 wherein:

(a) the housing means includes a case and a cover which define a chamber, with the case having a case surface extending along one side of the chamber and the cover having a cover surface extending along the other side of the chamber; and, (b) the operating slide, the first and second pawl means, the lock control means and the catch means each have portions carried in the chamber in overlying relationship sandwiched between the case surface and the cover surface.

53. The door lock of claim 52 wherein the cover carries a plurality of guide means which project from the cover surface into the chamber for engaging the first and second rotary latch bolt means to assist in guiding movements of the first and second rotary latch bolt means.

54. The door lock of claim 51 wherein the housing assembly carries a mounting pin which:

(a) extends through the chamber;

(b) extends through a slot formed in the operating slide;

(c) extends through holes formed in the first and second pawl means; and, (d) extends through a slot formed in the lock control means.

55. The door lock of claim 54 wherein the lock control means includes a control slide which is movable between locked and unlocked positions, and which is drivingly connected to the catch means to move the catch means between its locked and unlocked positions.

* * * * *